US007858871B2

(12) United States Patent
Fujii et al.

(10) Patent No.: US 7,858,871 B2
(45) Date of Patent: Dec. 28, 2010

(54) PLAYING DEVICE

(75) Inventors: Junji Fujii, Hamamatsu (JP); Ryuji Hashimoto, Hamamatsu (JP)

(73) Assignee: Yamaha Corporation (JP)

( * ) Notice: Subject to any disclaimer, the term of this patent is extended or adjusted under 35 U.S.C. 154(b) by 391 days.

(21) Appl. No.: 12/027,479

(22) Filed: Feb. 7, 2008

(65) Prior Publication Data

US 2009/0038463 A1 Feb. 12, 2009

(30) Foreign Application Priority Data

Feb. 9, 2007 (JP) ..... 2007-030337

(51) Int. Cl.
*G10H 3/00* (2006.01)

(52) U.S. Cl. ..... 84/723; 84/93; 84/600; 84/743

(58) Field of Classification Search ..... None
See application file for complete search history.

(56) References Cited

U.S. PATENT DOCUMENTS 5,668,340 A * 9/1997 Hashizume et al. ..... 84/742
7,554,028 B2 * 6/2009 Fujii ..... 84/741
7,605,324 B2 * 10/2009 Masuda et al. ..... 84/723
2007/0068372 A1 * 3/2007 Masuda et al. ..... 84/723
2007/0144336 A1 * 6/2007 Fujii ..... 84/723
2008/0295669 A1 * 12/2008 Hashimoto ..... 84/387 R
2009/0038463 A1 * 2/2009 Fujii et al. ..... 84/398
2009/0288549 A1 * 11/2009 Masuda et al. ..... 84/723

FOREIGN PATENT DOCUMENTS

JP 7-181965 A 7/1995
JP 2004-177828 A 6/2004
JP 2004-258443 A 9/2004
JP 2004-314187 A 11/2004

OTHER PUBLICATIONS

English translation of Office Action, mailed Nov. 11, 2008, issued in corresponding JP application 2007-030337.

* cited by examiner

*Primary Examiner*—Marlon T Fletcher
(74) *Attorney, Agent, or Firm*—Rossi, Kimms & McDowell LLP

(57) ABSTRACT

A playing device includes a hollow blowing body in which a vibration is applied to an internal air in the hollow blowing body in response to a vibration of lips of a player, a detecting portion which generates a detecting signal in response to the vibration in the blowing body, and a vibration applying portion which applies a vibration corresponding to the detecting signal to an air in the blowing body.

9 Claims, 3 Drawing Sheets

PLAYING DEVICE

BACKGROUND

The present invention relates to the technology to assist a performance of a player.

The technology to play automatically various instruments has been proposed in the prior art. For example, in Patent Literature 1 to Patent Literature 3, the robot for playing automatically a brass instrument such as a trumpet, or the like is disclosed.

[Patent Literature 1] JP-A-2004-258443

[Patent Literature 2] JP-A-2004-177828

[Patent Literature 3] JP-A-2004-314187

The technologies set forth in Patent Literature 1 to Patent Literature 3 give automatically the full-length performance of a brass instrument, but actually there are many users who wish to play the brass instrument by themselves. However, the brass instrument is one of instruments that need a considerable skilled technique for playing them. Also, such a problem exists that a heavy physical burden is imposed on the player in producing musical sounds at enough sound volume by the brass instrument. In spite of above circumstances, it is the present situation that the technology to assist effectively a performance of a brass instrument has not been proposed yet.

SUMMARY

It is an object of the present invention to solve the problem that a performance of a brass instrument should be assisted effectively.

In order to solve the above problems, a playing device according to the present invention, includes a hollow blowing body (for example, a mouthpiece 12 in FIG. 1) in which a vibration is applied to an internal air in the hollow blowing body in response to a vibration of lips of a player;

a detecting portion which generates a detecting signal in response to the vibration of the internal air in the blowing body; and a vibration applying portion which applies a vibration corresponding to the detecting signal to the internal air in the blowing body.

Preferably, the playing device further includes an outputting portion which outputs a sound wave corresponding to the detecting signal.

According to the above configuration, the sound wave is output based on the detecting signal corresponding to the vibration in the air in the blowing body. Therefore, for example, even if the pressure produced in the blowing body by the blowing of the player is not enough, the sound wave with a sufficient sound pressure can be reproduced by the outputting portion. Also, the vibration applying portion applies the vibration in the blowing body. Therefore, unless the blowing body is fitted to the brass instrument main body, a blowing feeling (a feeling of resistance to the lips in the blowing) equivalent to that in the fitted situation can be realized.

In the preferred mode of the present invention, the vibration applying portion is provided to an opposite side to a portion of the blowing body to which the lips of the player contact. According to this configuration, the inner surface of the blowing body is formed of a smooth curved surface over a wide range rather than the case where the vibration applying portion comes close to a portion of the blowing body that the lips contact. Therefore, such an advantage can be achieved that a blowing feeling equivalent to the actual brass instrument can be realized.

In the preferred mode of the present invention, the blowing body is a brass instrument mouthpiece which includes a rim portion, a cup portion, and a shank portion. The vibration applying portion is provided to the top end side of the shank portion and the detecting portion is provided to the rim portion or the cup portion. According to this configuration, an interval between the detecting portion and the vibration applying portion can be ensured sufficiently. Therefore, the howling caused due to a close arrangement of the detecting portion and the vibration applying portion can be suppressed.

In the preferred configuration of the present invention, the vibration applying portion includes a first vibrating portion and a second vibrating portion each having a diaphragm for applying the vibration to the internal air (an internal space) of the blowing body and a driving portion for causing the diaphragm to vibrate in response to the detecting signal. The diaphragm of the first vibrating portion and the diaphragm of the second vibrating portion are opposed to each other at an interval. According to this configuration, the diaphragm of the first vibrating portion and the diaphragm of the second vibrating portion are arranged to oppose to each other. Therefore, the pressure that the vibration applying portion applies to the internal air in the blowing body can be ensured sufficiently.

A playing device according to the concrete configuration of the present invention further includes a delaying unit which delays a detecting signal generated by the detection portion. The vibration applying portion applies the vibration corresponding to the detecting signal after delayed by the delaying unit to the internal air in the blowing body. According to this configuration, an operation in playing the brass instrument such that the sound wave is reflected at the top end portion and reaches the lips can be simulated. In the further preferred configuration, an amount of delay set by the delaying unit is equivalent to a time length in which a sound wave goes back and forth in a straight tube as a model of the blowing body whose both ends are closed. According to this configuration, an amount of delay required to reproduce faithfully the backpressure in the actual playing of the brass instrument can be calculated easily.

A playing device according to the preferred mode of the present invention further includes an operating piece which a user operates, and the delaying unit delays the detecting signal by a time in response to an operation applied to the operating piece. According to this configuration, an action such that a tube length of the resonance tube (further the backpressure) is changed in response to the operation applied to the operating piece can be reproduced faithfully.

In this configuration of the present invention, the outputting portion has a wind instrument main body, and a vibrating portion for producing the vibration corresponding to the detecting signal in an air in the wind instrument main body. According to this configuration, the player can blow the blowing body while holding the wind instrument main body. Therefore, the player can get a feeing as if such player plays actually the brass instrument. Indeed, any method of outputting the sound wave in response to the detecting signal may be employed in the present invention. For example, the speaker unit for emitting the sound in response to the detecting signal may be employed as the output portion.

In the playing device according to one variation of the present invention, the outputting portion in above configurations is constructed as a separate body. That is, the playing device includes a hollow blowing body in which a vibration is applied to an internal air in the blowing body in response to a vibration of lips of a player, a detecting portion for generating a detecting signal in response to the vibration in the blowing body, and a vibration applying portion for applying a vibration corresponding to the detecting signal to the internal air in the blowing body. According to this configuration, because the vibration applying portion applies the vibration in the air in the blowing body, a blowing feeling equivalent to that in playing the brass instrument main body can be realized.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A: First Embodiment

Figure 1:
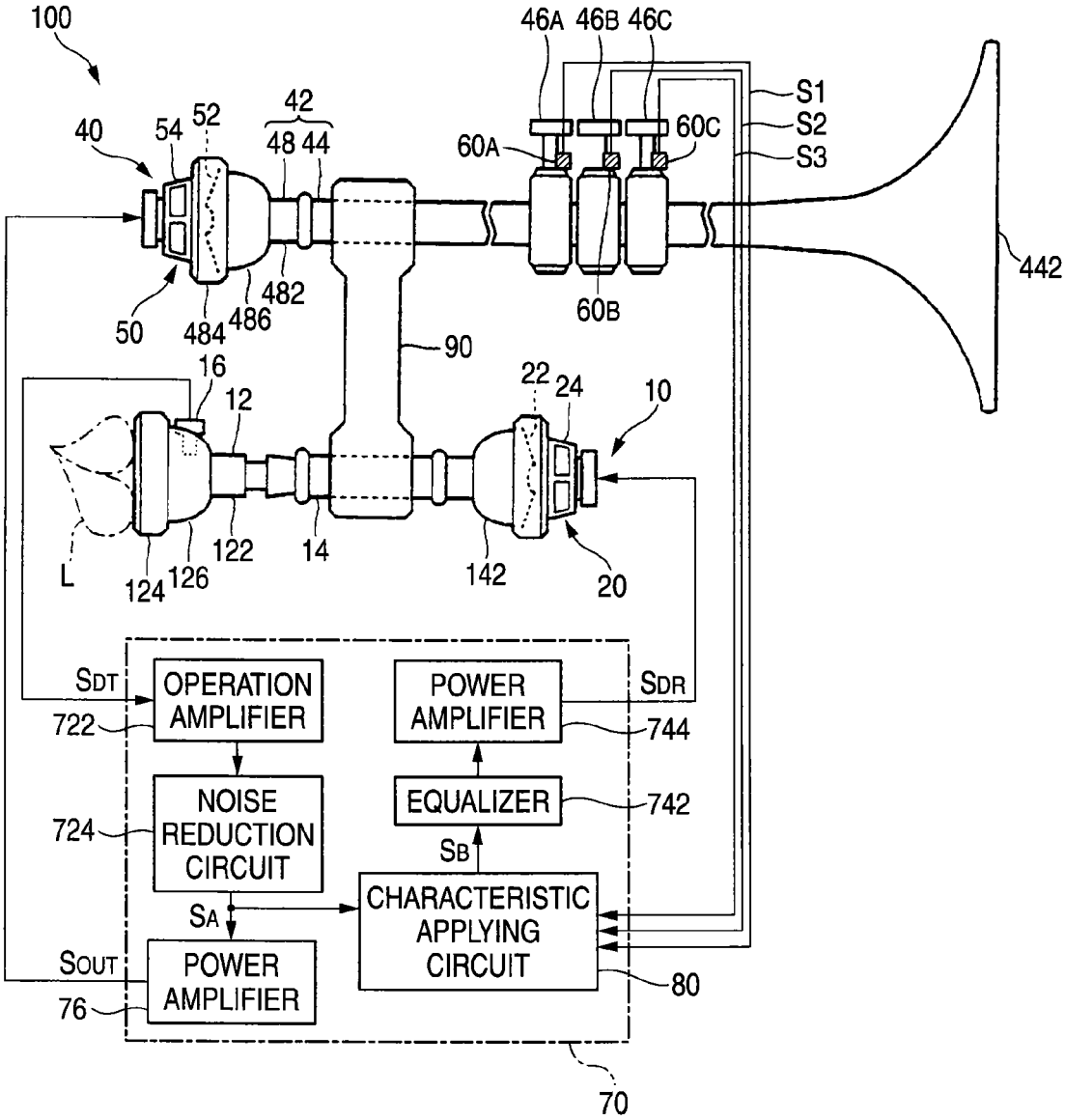
FIG. 1 is a conceptual view showing a configuration of a playing device according to a first embodiment of the present invention.

FIG. 1 is a block diagram showing a configuration of a playing device 100 according to a first embodiment of the present invention. The playing device 100 assists the playing of a brass instrument 42 by the player. As shown in FIG. 1, the playing device 100 has an inputting portion 10 that the player operates, an outputting portion 40 for outputting sound waves in response to the player's operation, and a control unit 70 for controlling the inputting portion 10 and the outputting portion 40. The inputting portion 10 and the outputting portion 40 are coupled mutually by a coupling portion 90.

The inputting portion 10 has a mouthpiece 12 for the brass instrument, a supporting body 14, a detecting portion 16, and a vibrating portion 20. The mouthpiece 12 is a component (blowing body) that the player blows. The mouthpiece 12 is a hollow member that is constructed by a cylindrical shank portion 122, an annular rim portion 124 that player's lips L contact, and a dome-like cup portion 126 for connecting the shank portion 122 and the rim portion 124. When the player vibrates the lips L that contact the rim portion 124, the vibration corresponding to the vibration of the lips L is produced in an air in the mouthpiece 12. The supporting body 14 is a circular cylindrical member at one end of which a dome-like cup member 142 is formed. The shank portion 122 of the mouthpiece 12 is inserted into the end of the supporting body 14 on the opposite side to the cup member 142.

The detecting portion 16 is inserted into a through hole formed in the cup portion 126 (or the rim portion 124) of the mouthpiece 12. The detecting portion 16 is a sensor that generates a detecting signal SDT in response to the vibration of the air in the mouthpiece 12. Preferably a sensor for detecting a pressure of the air in the mouthpiece 12 and a sensor for detecting the vibration of the lips L of the player are employed as the detecting portion 16. The control unit 70 generates a driving signal SDR and an output signal SOUT based on the detecting signal SDT. A concrete configuration of the control unit 70 will be described later.

The vibrating portion 20 is an actuator (vibration applying portion) that applies the vibration corresponding to the driving signal SDR to the air in the mouthpiece 12. The vibrating portion 20 of the present embodiment includes a diaphragm 22 that opposes to a space in the cup member 142 of the supporting body 14 (and also a space in the mouthpiece 12), and a driving portion 24 for causing the diaphragm 22 to vibrate in response to the driving signal SDR. Various speaker units such as the electrodynamic type, the piezoelectric type, the electrostatic type, and the like are used as the vibrating portion 20.

As shown in FIG. 1, the outputting portion 40 includes the brass instrument 42, a vibrating portion 50, and three operation detecting portions 60 (60A, 60B, 60C). The brass instrument 42 of the present embodiment is a trumpet. The brass instrument 42 includes a wind instrument main body 44 and a mouthpiece 48. Three piston valve type operating pieces 46 (46A, 46B, 46C) that the player operates are provided to the wind instrument main body 44. The operation detecting portion 60A outputs an operation signal S1 indicating whether or not the operating piece 46A is operated. Similarly, the operation detecting portion 60B outputs an operation signal S2 indicating whether or not the operating piece 46B is operated, and the operation detecting portion 60C outputs an operation signal S3 indicating whether or not the operating piece 46C is operated.

Like the mouthpiece 12, the mouthpiece 48 is constructed by a shank portion 482, a rim portion 484, and a cup portion 486. The shank portion 482 of the mouthpiece 48 is inserted into the wind instrument main body 44. One end portion of the coupling portion 90 is fixed to a portion of the wind instrument main body 44 near the mouthpiece 48. Also, the other end portion of the coupling portion 90 is fixed to the supporting body 14. That is, the brass instrument 42 is supported in a position at a predetermined interval from the mouthpiece 12 (the inputting portion 10). The player presses on demand one or plural operating pieces 46 corresponding to a desired tone, while causing the lips L to contact the mouthpiece 12 to blow.

The vibrating portion 50 is the actuator that applies the vibration corresponding to the output signal SOUT to the air in the wind instrument main body 44. Like the vibrating portion 20, the vibrating portion 50 of the present embodiment is a speaker unit that includes a diaphragm 52 that opposes to an inside of the mouthpiece 48, and a driving portion 54 for causing the diaphragm 52 to vibrate in response to the output signal SOUT.

Next, a concrete example of the control unit 70 will be explained hereunder. An operation amplifier 722 in FIG. 1 amplifies the output signal SOUT that the detecting portion 16 generates. A noise reducing circuit 724 generates a signal SA by reducing a noise contained in the amplified detecting signal SDT. The detecting signal SDT is produced by detecting the vibration that the vibrating portion 20 generates in the mouthpiece 12 in response to the driving signal SDR. For this reason, in the configuration to which the noise reducing circuit 724 is not provided, when the noise is generated in the detecting signal SDT or the driving signal SDR, such noise is increased every detection time of the detecting portion 16 to cause the howling. In the present embodiment, a howling caused due to the noise can be reduced by the noise reducing circuit 724.

The signals SA output from the noise reducing circuit 724 are supplied to a characteristic applying circuit 80 and a power amplifier 76. The characteristic applying circuit 80 generates a signal SB by applying the acoustic characteristic of the brass instrument 42 (the resonance characteristic) to the signal SA. In more details, the characteristic applying circuit 80 generates the signal SB by delaying the signal SA such that a pressure applied to the lips L of the player from the brass instrument 42 (referred to as a "backpressure" hereinafter) when the player blows directly the brass instrument 42 can be reproduced by the vibration of the diaphragm 22 to simulate the backpressure. In this case, concrete configuration and operation of characteristic applying circuit 80 will be described later.

The signal SB generated by the characteristic applying circuit 80 is supplied to an equalizer 742. The detecting signal SDT is generated by the detecting portion 16 to reflect the vibration that the vibrating portion 20 produced in the mouthpiece 12. Thus, frequency components of the vibration generated in the mouthpiece 12 based on the detecting signal SDT and the driving signal SDR are increased gradually to act as the cause of the howling. Therefore, the equalizer 742 suppresses the howling by reducing selectively frequency components of the signal SB in a predetermined frequency band containing frequencies of the vibration in the mouthpiece 12.

A power amplifier 744 in FIG. 1 amplifies the signal SB after adjusted by the equalizer 742 to generate the driving signal SDR and then output it to the driving portion 24. The driving portion 24 in the vibrating portion 20 causes the diaphragm 22 to vibrate in response to the driving signal SDR. As a result, not only the vibration generated by the player's blowing but also the vibration generated in response to the driving signal SDR (i.e., the vibration generated in response to the detecting signal SDT) is applied to the air in the mouthpiece 12. As described above, the detecting signal SDT gives the signal that corresponds to the vibration produced in the mouthpiece 12 due to the vibration of the lips L of the player and the vibration of the diaphragm 22.

Meanwhile, the power amplifier 76 amplifies the signal SA to generate the output signal SOUT and then output it to the vibrating portion 50. The driving portion 54 of the vibrating portion 50 causes the diaphragm 52 to vibrate in response to the output signal SOUT. Hence, the vibration generated in response to the output signal SOUT (i.e., the vibration generated in response to the detecting signal SDT) is produced in the mouthpiece 48 and the wind instrument main body 44. In other words, the vibration responding to the vibration generated by the player's blowing and the vibration of the vibrating portion 20 (the backpressure) is produced in the brass instrument 42. According to the above operations, like the case where the player blows directly the brass instrument 42, sound waves having frequencies in answer to the player's blowing of the mouthpiece 12 and respective operations of the operating pieces 46 are emitted from a top end portion (bell portion) 442 of the brass instrument 42.

Since the output signal SOUT is generated after the operation amplifier 722 or the power amplifier 76 amplified the detecting signal SDT, the sound waves with enough sound pressure can be emitted from the brass instrument 42 even though the sound pressure being given to the inside of the mouthpiece 12 by the player is small. Therefore, the physical burden of the player can be lessened. That is, according to the playing device 100 of the present embodiment, the play of the brass instrument 42 can be assisted effectively.

Figure 2:
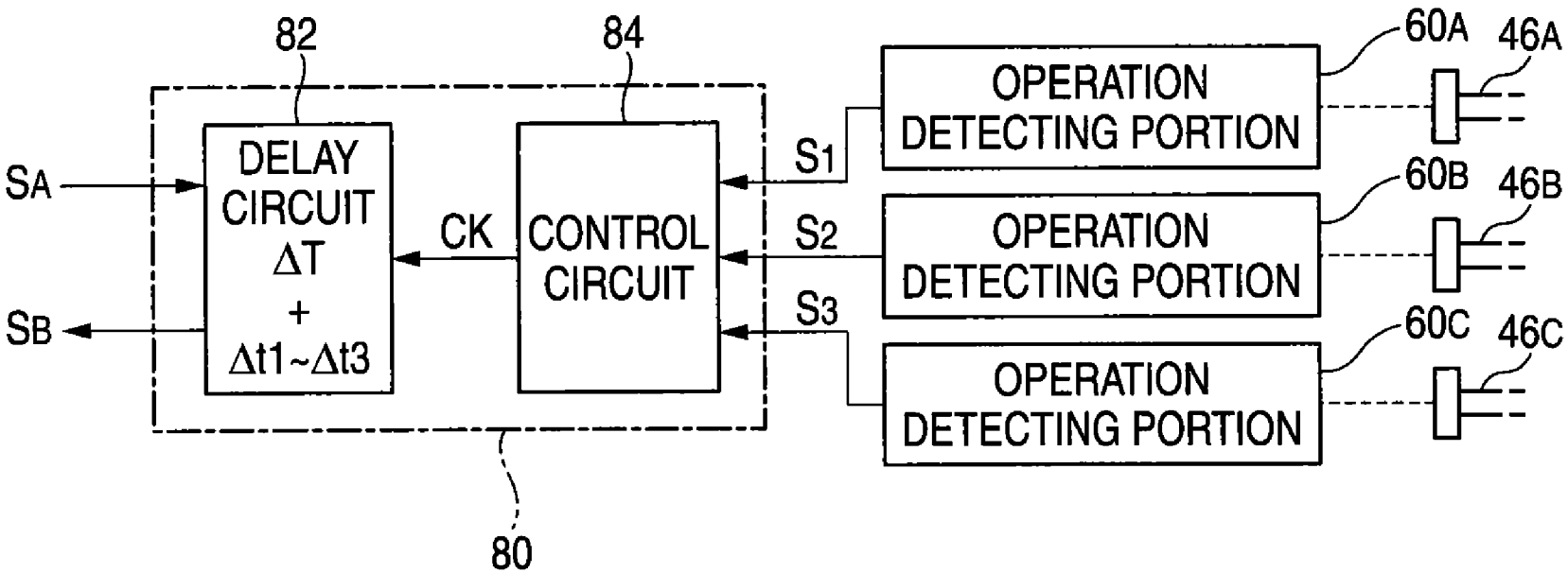
FIG. 2 is a block diagram showing a configuration of a characteristic applying circuit.

Next, a concrete configuration of the characteristic applying circuit 80 will be explained with reference to FIG. 2 hereunder. As shown in FIG. 2, the characteristic applying circuit 80 includes a delay circuit 82, and a control circuit 84. The delay circuit 82 generates the signal SB by delaying the signal SA and outputs it. The control circuit 84 controls an amount of delay (delay time) in the delay circuit 82 based on the operation signals S1 to S3. In more details, the control circuit 84 sets an amount of delay in the delay circuit 82 in answer to a combination of the operating pieces 46 that the player operated (i.e., the player's fingering).

The delay circuit 82 of the present embodiment is the BBD (Bucket Brigade Device) in which an amount of delay is changed in response to a frequency of a clock signal CK being supplied from the control circuit 84. Therefore, the control circuit 84 generates the clock signal CK of the frequency that responds to a combination of the operating pieces 46 that the player operates, and then outputs it to the delay circuit 82.

When the player blows directly the brass instrument 42, the sound waves generated in the mouthpiece 48 travels through an inside of the brass instrument 42 and then is reflected by the top end portion 442. Therefore, the backpressure as a pressure of the reflected wave acts on the lips L of the player. In the present embodiment, an amount of delay in the delay circuit 82 is set such that the backpressure acting on the lips L of the player in blowing the brass instrument 42 is simulated by the vibration of the diaphragm 22 generated in response to the driving signal SDR.

For example, when none of the operating pieces 46 is operated, the control circuit 84 controls the frequency of the clock signal CK such that an amount of delay in the delay circuit 82 is set to a predetermined value ΔT. Also, when any one of the operating pieces 46 is operated, the control circuit 84 controls the frequency of the clock signal CK such that an amount of delay in the delay circuit 82 corresponds to an added value of a predetermined value ΔT and time lengths (Δt1 to Δt3) corresponding to one or plural operating pieces 46 being now operated respectively. For example, when only the operating piece 46A is operated, an amount of delay in the delay circuit 82 is set to an added value (ΔT+Δt1) of a predetermined value ΔT and a time length Δt1 corresponding to the operating piece 46A. Also, when the operating piece 46A and the operating piece 46B are operated, an amount of delay in the delay circuit 82 is set to an added value (ΔT+Δt1+Δt2) of a predetermined value ΔT and a time length Δt1 corresponding to the operating piece 46A and a time length Δt2 corresponding to the operating piece 46B. That is, an amount of delay responding to a pitch of the sound being output from the brass instrument 42 is set in the delay circuit 82. In this manner, since an amount of delay in the delay circuit 82 is changed in response to the operation of the operating pieces 46, a variation of the backpressure caused due to a change of a tube length of the brass instrument 42 based on the player's fingering can be reproduced faithfully.

Next, a concrete way of setting an amount of delay by the delay circuit 82 will be explained hereunder.

A neighboring area of the top end portion 442 of the brass instrument 42 is shaped into a circular-cone curved surface (bell portion) whose diameter is increased toward the top end portion 442. It is not easy to decide an amount of delay in the delay circuit 82 such that a behavior of the sound wave in such shaped tubular body (referred to as a "taper tube" hereinafter) can be simulated. Therefore, in the present embodiment, an amount of delay in the delay circuit 82 is decided by utilizing a linear tubular body (straight tube) having the equal diameter over the whole length as a model of the brass instrument 42.

Like the tubular body whose both ends are opened, a standing wave is generated in the taper tube such as the brass instrument 42, or the like in the resonance modes corresponding to respective frequencies that are an integral multiple of a fundamental frequency respectively. In contrast, in the straight tube whose one end is opened and the other end is closed (referred to as a "open-close straight tube" hereinafter), there exist only the resonance modes corresponding to respective frequencies that are an odd-numbered multiple of a fundamental frequency respectively. As described above, since the open-close straight tube does not agree with the taper tube with regard to the type of the resonance mode, such open-close straight tube is not always adequate to the model that is used to analyze a behavior of the sound wave in the taper tube. Therefore, in the present embodiment, an amount of delay in the delay circuit 82 is decided by utilizing a linear tubular body whose both ends are closed (referred to as a "close-close straight tube" hereinafter) as a model of the brass instrument 42. The characteristics of the close-close straight tube agree with those of the taper tube in such a point that there exist the resonance modes corresponding to respective frequencies that are an integral multiple of a fundamental frequency respectively. As a result, in the present embodiment, the analysis (specification of an amount of delay) that is faithfully reflective of the actual characteristic of the brass instrument 42 can be carried out in contrast to the case where a behavior of the sound wave in the brass instrument 42 is analyzed by utilizing the open-close straight tube.

When the close-close straight tube whose tube length of the sound wave of the brass instrument 42 (a total length of a resonance tube) is set to D in a situation that none of the operating pieces 46 is operated is supposed, a time length required while the sound wave goes back and forth in the close-close straight tube (i.e., travels to and fro over a distance 2D) is calculated as an amount of delay ΔT. Also, an amount of delay (ΔT+Δt1) in the delay circuit 82 when the operating piece 46A is operated is set to a time length required while the sound wave goes back and forth in the close-close straight tube whose total length of the resonance tube given when the operating piece 46A is operated is assumed as a tube length D. Similarly, an amount of delay (ΔT+Δt1+Δt2) when the operating piece 46A and the operating piece 46B are operated is set to a time length required while the sound wave goes back and forth in the close-close straight tube whose total length of the resonance tube given when the operating piece 46A and the operating piece 46B are operated is assumed as a tube length D. With the above procedures, an amount of delay is decided in all combinations of the operating pieces 46 that the player presses (eight ways in total containing the case where no operating piece is pressed) respectively.

As described above, in the present embodiment, since the diaphragm 22 vibrates based on the driving signal SDR that is derived by delaying the detecting signal SDT, the similar backpressure to that applied when the player blows directly the brass instrument 42 acts on the lips L of the player. Therefore, though the wind instrument main body 44 is not fitted to the mouthpiece 12, a blowing feeling equivalent to that in the actual playing of the brass instrument 42 can be realized. Advantages of the present embodiment will be described in detail while using the configuration in which the vibrating portion 20 is omitted in FIG. 1 (i.e., the configuration in which the backpressure does not act on the lips L of the player) as a comparative example.

Upon playing the brass instrument 42, the player decides exactly the pitch on the basis of a level of the backpressure (a feeling of resistance to the blowing) acting on the lips L. On the contrary, in the comparative example, the pitch to be played is adjusted freely in response to the force that the player applies to the lips L. In other words, in the comparative example, such a problem exists that it is difficult to play in the precise pitch because there is no standard to play the particular pitch. In the present embodiment, such an advantage is provided that, because a pressure equivalent to the backpressure acts on the lips L of the player, a desired pitch can be played exactly on the basis of a level of the backpressure, like the actual playing operation of the brass instrument 42.

Also, in the comparative example, when the player changes continuously a power applied to the lips L, the pitch being output from the outputting portion 40 also changes continuously because there is no backpressure. However, in the actual brass instrument 42, the easy-to-play pitch and the hard-to-play pitch are distinguished mutually based on a level of the backpressure (whether the resonance occurs or not). That is, the pitches that can be played by the brass instrument 42 are discrete. In the present embodiment, because the backpressure acts on the lips L of the player, the sound respective pitches of which are discrete and clear can be output from the outputting portion 40, like the actual brass instrument 42.

In the brass instrument 42, respective pitches become stable because a variation of the backpressure is in phase with the vibration of the lips L of the player. In the comparative example, because no backpressure exists, it is difficult to maintain stably the particular pitch. In the present embodiment, such an advantage can be achieved that, because the backpressure is applied to the lips L of the player, the particular pitch can be played stably, like the actual playing operation of the brass instrument 42.

B: Second Embodiment

Next, a second embodiment of the present invention will be explained hereunder. Here, in the present embodiment, the same reference symbols are affixed to the elements whose operations and functions are common to the first embodiment, and therefore their detailed explanation will be omitted appropriately herein.

Figure 3:
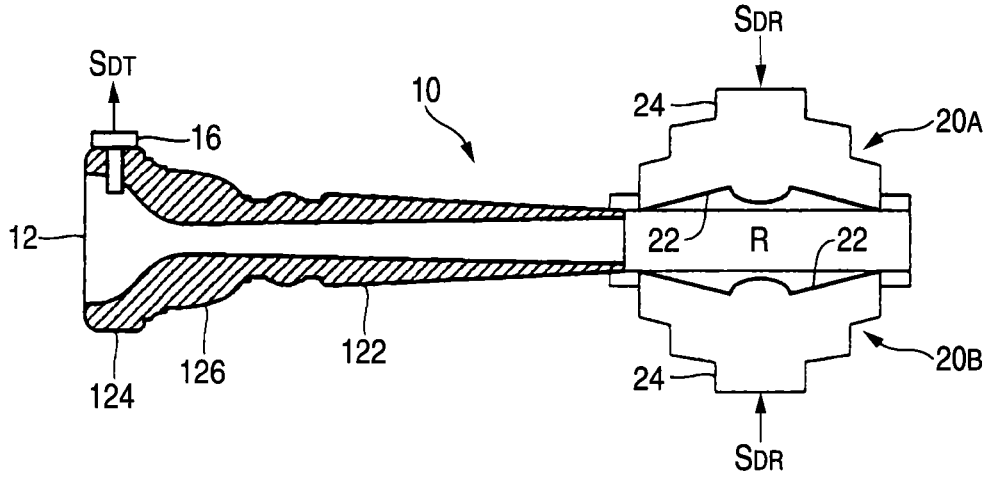
FIG. 3 is a sectional view showing a configuration of an inputting portion according to a second embodiment of the present invention.

FIG. 3 is a sectional view showing a configuration of the inputting portion 10. As shown in FIG. 3, the inputting portion 10 of the present embodiment has vibrating portions 20A and 20B instead of the vibrating portion 20 in FIG. 1. Each of the vibrating portions 20A and 20B has the diaphragm 22 and the driving portion 24, like the vibrating portion 20. The vibrating portions 20A and 20B are arranged on the top end side of the mouthpiece 12 such that respective diaphragms 22 oppose to each other at an interval. In more detail, the diaphragm 22 of the vibrating portion 20A and the diaphragm 22 of the vibrating portion 20B oppose to each other to put a space R, which passes through the inside of the mouthpiece 12, between them. The common driving signal SDR is supplied to respective driving portions 24 of the vibrating portions 20A and 20B. Therefore, the diaphragm 22 of the vibrating portion 20A and the diaphragm 22 of the vibrating portion 20B vibrate in phase with each other. Here, the configuration in which the detecting portion 16 is arranged to the rim portion 124 of the mouthpiece 12 is illustrated in FIG. 3.

According to the above configuration, the space R is compressed and expanded following upon the operations of the vibrating portions 20A and 20B. Therefore, an intensity of the backpressure acting on the lips L of the player can be ensured sufficiently rather than the configuration in which only one vibrating portion 20 is used as in the first embodiment.

Figure 4:
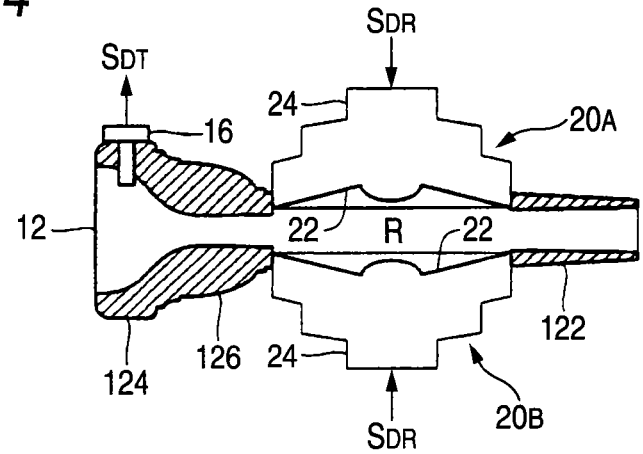
FIG. 4 is a sectional view showing a configuration of an inputting portion according to another mode.

Here, the positions where the vibrating portions 20A and 20B are provided are not limited to the top end side of the shank portion 122. For example, as shown in FIG. 4, such a configuration may also be employed that the vibrating portions 20A and 20B are arranged such that they are opposed mutually to put the space R as a clearance formed between the shank portion 122 and the cup portion 126 in the mouthpiece 12 between them. Also, as shown in FIG. 5, such a configuration may also be employed that side portions of the vibrating portions 20A and 20B are coupled to the mouthpiece 12 (in the example in FIG. 5, the base end portion of the shank portion 122).

Figure 5:
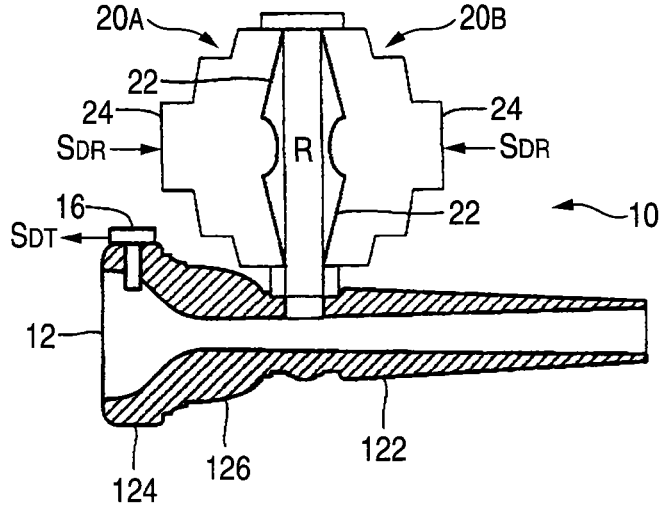
FIG. 5 is a sectional view showing a configuration of an inputting portion according to still another mode.

In this case, as shown in FIG. 4 and FIG. 5, in the configuration in which the vibrating portions 20A and 20B are provided to the base end portion of the shank portion 122, the detecting portion 16 comes close to the vibrating portions 20A and 20B. Therefore, although the equalizer 742 is installed into the control unit 70, the howling readily occurs. In contrast, the configuration in FIG. 3 possesses such an advantage that, because the detecting portion 16 is separated from the vibrating portions 20A and 20B at a considerable distance, a possibility of occurrence of the howling can be reduced. Also, as shown in FIG. 4 and FIG. 5, in the configuration in which the vibrating portions 20A and 20B are positioned close to the rim portion 124 and the cup portion 126, the unevenness generated by providing the vibrating portions 20A and 20B is present in portions, which are positioned immediately after the throat and through which the sound wave passes, of the inner surface of the mouthpiece 12. Therefore, a blowing feeling may become worse rather than the mouthpiece 12 whose internal surface is formed of a smooth curved surface. In contrast, as shown in FIG. 3, in the configuration in which the vibrating portions 20A and 20B are provided to the top end side of the shank portion 122, the inner surface can be formed of the smooth curved surface over the full length of the mouthpiece 12. Therefore, a blowing feeling equivalent to the ordinary brass instrument 42 can be realized.

C: Variations

Various variations can be applied to the above embodiments. Modes of a concrete variation are illustrated as follows. Also, respective modes given in the following may be combined mutually appropriately.

(1) Variation 1

In the above embodiments, the outputting portion 40 having the brass instrument 42 and the vibrating portion 50 is illustrated, but the configuration for radiating the sound wave in response to the detecting signal SDT may be changed appropriately. For example, the sound wave in response to the detecting signal SDT may be radiated by supplying the output signal SOUT, which is output from the power amplifier 76, to the speaker unit. When the brass instrument 42 is not used, preferably such a configuration may be employed that the operation detecting portion 60 detects the operations applied to various inputting devices such as a keyboard instrument, and the like and then the control circuit 84 controls an amount of delay in the delay circuit 82 in answer to this detected result. In this case, as shown in FIG. 1, according to the configuration that the brass instrument 42 is used as the outputting portion 40, such an advantage can be achieved that, when the player blows the mouthpiece 12 of the inputting portion 10 while holding the brass instrument 42 and operating appropriately respective operating pieces 46, a playing feeling equivalent to the actual play of the brass instrument 42 can be maintained.

(2) Variation 2

The configuration of the control unit 70 may be varied appropriately. For example, the noise reducing circuit 724 or the equalizer 742 shown in FIG. 1 may be omitted. Also, the configuration in which the detecting signal SDT is delayed by the analog delay circuit 82 utilizing the BBD element is illustrated in above embodiments, but the digital delay circuit 82 may be utilized. In addition, if a configuration in which the detecting signal SDT generated by the detecting portion 16 is supplied directly to the vibrating portion 20 (the vibrating portions 20A and 20B) via the wiring (i.e., a configuration from which the control unit 70 is omitted) is employed, a desired advantage such that the backpressure is applied to the lips L of the player can be achieved in principle. That is, any configuration is sufficient for one preferred embodiment of the present invention if the vibration applying portion (the vibrating portion 20 or the vibrating portions 20A and 20B) for applying the vibration responding to the detecting signal SDT to the air in the mouthpiece 12 is equipped, and any process may be applied to the detecting signal SDT.

(3) Variation 3

In respective embodiments, the trumpet is illustrated as the brass instrument 42. But the present invention is applied to other brass instruments 42 such as a trombone, a horn, a tuba, and the like similarly to the above. In the mode where the trombone is employed as the brass instrument 42, an amount of delay in the delay circuit 82 is controlled in response to an amount of displacement of the slide being operated by the player, for example.

(4) Variation 4

The mouthpiece 12 used to blow the brass instrument 42 is not always employed in the inputting portion 10. Any hollow component that the player blows (blowing body) may be employed if such component can apply the vibration to the air in the inside in response to the vibration of the lips L of the player. A shape of the blowing body (shape and material) may be set arbitrarily.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2007-030337 filed on Feb. 9, 2007, the contents of which are incorporated herein for reference.

What is claimed is:

1. A playing device, comprising:

a hollow blowing body in which a vibration is applied to an internal air in the hollow blowing body in response to a vibration of lips of a player;

a detecting portion which generates a detecting signal in response to the vibration of the internal air in the blowing body; and a vibration applying portion which applies a vibration corresponding to the detecting signal to the internal air in the blowing body;

wherein the vibration applying portion includes a first vibrating portion and a second vibrating portion each having a diaphragm for applying the vibration to the internal air in the blowing body and a driving portion for causing the diaphragm to vibrate in response to the detecting signal, and wherein the diaphragm of the first vibrating portion and the diaphragm of the second vibrating portion are opposed to each other at an interval.

2. The playing device according to claim 1, wherein the vibration applying portion is provided to an opposite side to a portion of the blowing body to which the lips of the player contact.

3. The playing device according to claim 2, wherein the blowing body is a brass instrument mouthpiece which includes a rim portion, a cup portion, and a shank portion.

4. The playing device according to claim 1, further comprising:

a delaying unit which delays a detecting signal generated by the detection portion; and wherein the vibration applying portion applies the vibration corresponding to the detecting signal after delayed by the delaying unit to the internal air in the blowing body.

5. The playing device according to claim 4, wherein an amount of delay set by the delaying unit is equivalent to a time length in which a sound wave goes back and forth in a straight tube as a model of the blowing body whose both ends are closed.

6. The playing device according to claim 5, further comprising:

an operating piece which a user operates, wherein the delaying unit delays the detecting signal by a time in response to an operation applied to the operating piece.

7. The playing device according to claim 1, further comprising:

an outputting portion which outputs a sound wave corresponding to the detecting signal.

8. The playing device according to claim 7, wherein the outputting portion includes:

a wind instrument main body, and a vibrating portion which applies the vibration corresponding to the detecting signal to the internal air in the wind instrument main body.

9. A method of playing a playing device, comprising:

in response to a vibration of lips of a player, applying a vibration to an internal air in a hollow blowing body;

generating a detecting signal in response to the vibration of the internal air in the blowing body; and applying, by a vibration applying portion, a vibration, corresponding to the detecting signal, to the internal air in the blowing body;

wherein the vibration applying portion includes a first vibrating portion and a second vibrating portion each having a diaphragm for applying the vibration to the internal air in the blowing body and a driving portion for causing the diaphragm to vibrate in response to the detecting signal, and wherein the diaphragm of the first vibrating portion and the diaphragm of the second vibrating portion are opposed to each other at an interval.

* * * * *